US005333843A

United States Patent [19]

Kneis et al.

[11] Patent Number: 5,333,843

[45] Date of Patent: Aug. 2, 1994

[54] DEVICE FOR INSTALLING AND REMOVING GAS PURGING PLUGS FOR METALLURGICAL VESSELS

[75] Inventors: Leopold Kneis, Grimmenstein; Manfred Slamenik, Trofaiach, both of Austria

[73] Assignee: Veitscher-Magnesitwerke-Actien-Gesellschaft, Vienna, Austria

[21] Appl. No.: 989,022

[22] PCT Filed: Sep. 4, 1991

[86] PCT No.: PCT/AT91/00101

§ 371 Date: Apr. 19, 1993

§ 102(e) Date: Apr. 19, 1993

[87] PCT Pub. No.: WO92/04998

PCT Pub. Date: Apr. 2, 1992

[30] Foreign Application Priority Data

Sep. 14, 1990 [AT] Austria ..... 1870/90

[51] Int. Cl.[5] ..... B22D 1/00; C21C 7/072

[52] U.S. Cl. ..... 266/271; 266/220

[58] Field of Search ..... 266/271, 268, 269, 220, 266/265, 270

[56] References Cited

U.S. PATENT DOCUMENTS 3,190,629 6/1965 Draper ..... 266/271

5,007,621 4/1991 Rothfuss et al. ..... 266/220

*Primary Examiner*—Scott Kastler

*Attorney, Agent, or Firm*—John F. A. Earley; John F. A. Earley, III

[57] ABSTRACT

The present invention pertains to a device for installing and removing gas purging plugs (17) for metallurgical vessels, comprising a guide (7) for axially displacing the gas purging plug (17). On the one hand, movement exactly in the axial direction can be achieved during introduction, and, on the other hand, the extracted gas purging plug can be brought into an ejection position by providing hinges (6, 11), which permit at least two independent pivoting movements of the gas purging plug (17) around different axes (6a, 11a).

14 Claims, 10 Drawing Sheets 4
20a
26
21a
24
20b
21b
11
12
11a
14
15b
16
1
2
28
17a
17
18

4
26
25
24
12
11a
22
14
15a
19
16
17
1
2
17a
18
28
21a
13
10a
11
9
8
27
10
7
6a
6
5
3
23

1
2
18
3
5
6a
6
8
7
17a
17
16
19
15a
14
22
11
23
9
11a
12
10
24
27
10a
13
25
26
4

DEVICE FOR INSTALLING AND REMOVING GAS PURGING PLUGS FOR METALLURGICAL VESSELS

BACKGROUND OF THE INVENTION

The present invention pertains to a device for installing and removing gas purging plugs for metallurgical vessels, especially for ladles, with a guide for axially displacing the gas purging plug.

A device suitable for extracting gas purging plugs, which consists of a frame attached to the bottom of the vessel, is described in DE-A1-33,30,105. A spindle, via which the force needed for the extraction can be applied, is mounted in the frame. It is disadvantageous that it is very difficult to eject the used gas purging plug because of the very cramped space conditions. Devices for inserting and extracting gas purging plugs, which consist of a lever hinged to one end of the bottom of the vessel, have been known from DE-A1,38,33,504. The gas purging plug is arranged in a hinged manner approximately in the center of the lever arm. Such devices are permanently attached to the bottom of the vessel, because they are also used as a closure for holding the gas purging plug during operation. Consequently, a separate device is needed for each site of installation of a gas purging plug. Another disadvantage of such devices is the fact that hot gases may escape from the vessel, and if these gases come into contact with a gas purging plug freshly coated with a layer of mortar, they bring about an undesired, nonuniform and excessively rapid drying. In addition, the nozzle brick is accessible with very great difficulty only for cleaning operations that may be necessary.

Exactly parallel introduction of the gas purging plug is not possible in this manner.

SUMMARY OF THE INVENTION

The task of the present invention is to avoid these disadvantages, and to provide a device that makes possible both the extraction and the insertion of gas purging plugs, wherein the gas purging plug to be inserted can be brought, on the one hand, into a position in which a layer of mortar can be applied with ease, and, on the other hand, movement exactly in the axial direction during introduction can be achieved. In addition, a position is to be provided, in which the extracted gas purging plug can easily be ejected.

The device is therefore designed according to the present invention such that hinges are provided, which permit at least two independent pivoting movements of the gas purging plug around different axes.

To extract a gas purging plug, the metallurgical vessel is usually brought into the lying position, in which the bottom of the vessel stands upright, and the axis of the gas purging plug is consequently horizontal. Exactly axial movement of the gas purging plug is guaranteed by the guide, so that the mortar is prevented from being stripped off, and a uniform joint is obtained. Another advantage of the present invention is that the nozzle brick can easily be freed from mortar residues after extraction of the gas purging plug.

If the two axes are essentially at right angles to one another, the device is attached to the vessel such that the axis of one of the hinges will be essentially vertical, so that pivoting can be performed without an essential expenditure of force, because the force of gravity does not have to be overcome. The second hinge with the essentially vertical axis is used to pivot the gas purging plug completely out of the area of the opening and to bring it into a position with the vertical axis, in which operations can easily be performed on the gas purging plug. In particular, the layer of mortar necessary for correct seating can thus easily be applied to the vertical gas purging plug.

It is favorable for the guide to contain a bar, on which a slide is slidably arranged. This permits simple and rapid displacement of the gas purging plug.

One particularly advantageous design embodiment is obtained if a first hinge permits the pivoting of the guide in relation to the vessel, and a second hinge permits pivoting of the gas purging plug in relation to the slide. The second hinge may hold rotatably on the slide a head that can be fixed by a locking means.

The insertion and the extraction of the gas purging plug is facilitated if a guide tube is guided axially displaceably in the head for manipulating the gas purging plug. A tool can be put on the guide tube for connection to the gas purging plug. This tool may have a different design for inserting the gas purging plug than for extraction.

To press the gas purging plug into the vessel during insertion, the device may have a mounting means for a compressed-air hammer. This compressed-air hammer may be attached at the outer end of the guide tube. The joint can thus be prepared precisely according to the specified value, and the operation can be performed by a single worker.

Support plungers, which are arranged in a regular pattern around the axis of the gas purging plug, are preferably provided for extracting the gas purging plug. Furthermore, hydraulic plungers may also be provided for extracting the gas purging plug. This makes it possible to extract the gas purging plug in a simple and reliable manner.

In a special design variant of the present invention, two support plungers, whose axes are located in one plane, which contains the axis of the gas purging plug, are provided, and they [support plungers] are supported at the head. As a result, the force needed for extraction can be transmitted from the gas purging plug to the vessel in a favorable manner, without loading the hinges of the device.

According to another design variant of the present invention, the support plungers used for the extraction process may be designed as hydraulic plungers, which act against the direction of extraction. The design and the handling of the device are simplified as a result.

Since it is not necessary for the device to permanently remain on the vessel, provisions may be made for it to contain a coupling piece for detachably fastening it to the vessel. A plate, which is attached to the bottom of the vessel or the flange of the gas purging plug, and which may be provided with a refractory backfill, is used to hold the gas purging plug during operation.

It is also advantageous for a fine adjustment means to be provided in the area of the slide, in order to accurately align the gas purging plug. Tolerances or clearances in the area of the hinges or the guide can thus easily be compensated, so that exactly axial movement of the gas purging plug is always guaranteed.

BRIEF DESCRIPTION OF THE DRAWINGS

The present invention will be explained in greater detail below on the basis of the exemplary embodiment represented in the drawings.

FIG. 1 shows a top view of the device according to the present invention during the extraction of the gas purging plug; FIG. 2 shows a side view during the extraction of the gas purging plug; FIG. 3 shows a top view of the device according to the present invention during the insertion of the gas purging plug; FIG. 4 shows a side view during the insertion of the gas purging plug; FIG. 5 shows a view corresponding to FIG. 1 with the gas purging plug extracted; FIG. 6 shows such a view on a reduced scale, with the gas purging plug pivoted away; FIG. 7 shows a front view on a reduced scale in the position for ejecting the gas purging plug; and FIG. 8 shows a front view on a reduced scale in the position for attaching a new gas purging plug. FIG. 9 shows a top view, and FIG. 10 shows a side view.

DETAILED DESCRIPTION OF THE INVENTION

Figure 1:
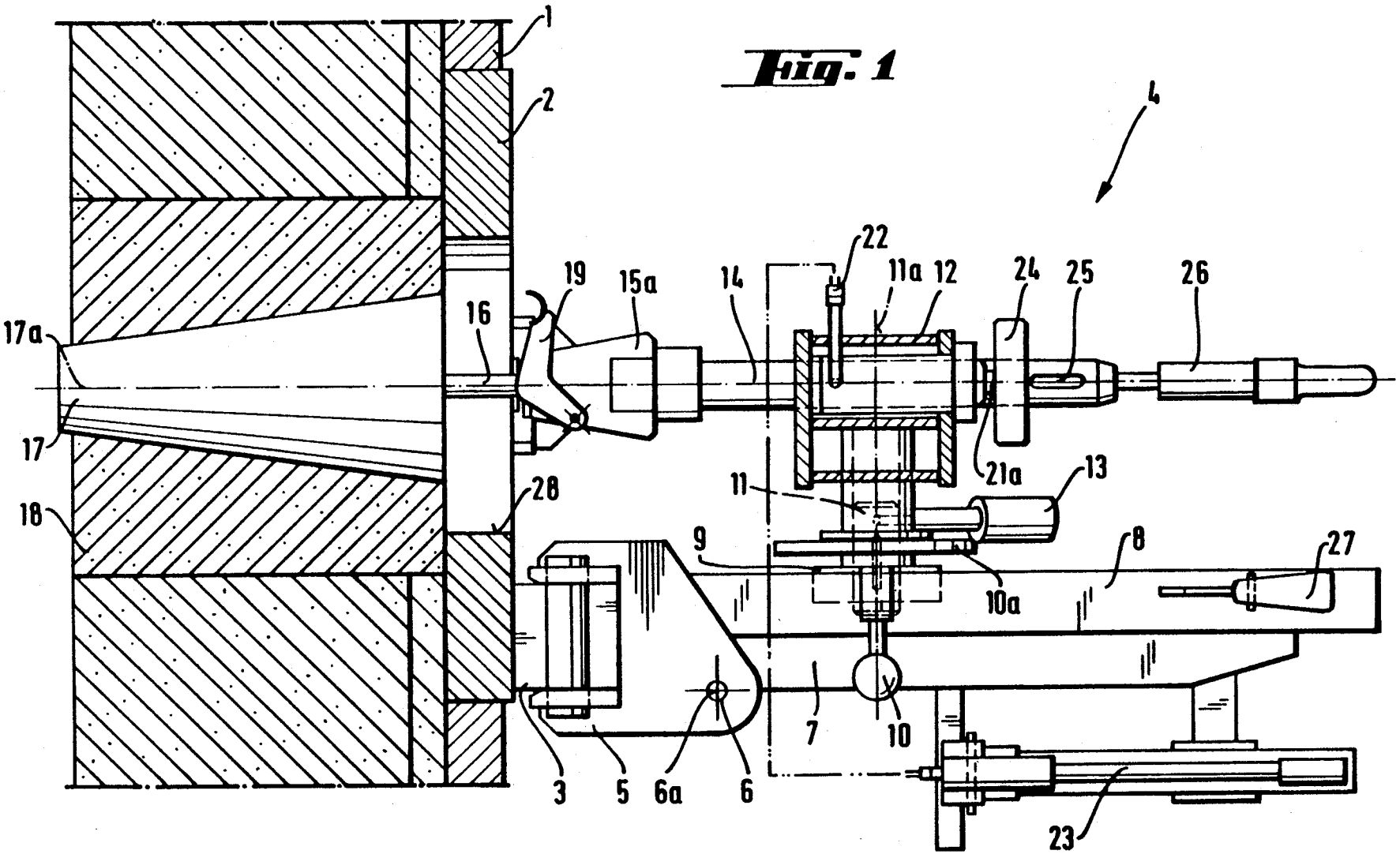
FIGS. 1 through 8 show a first design variant; namely.
Figure 2:
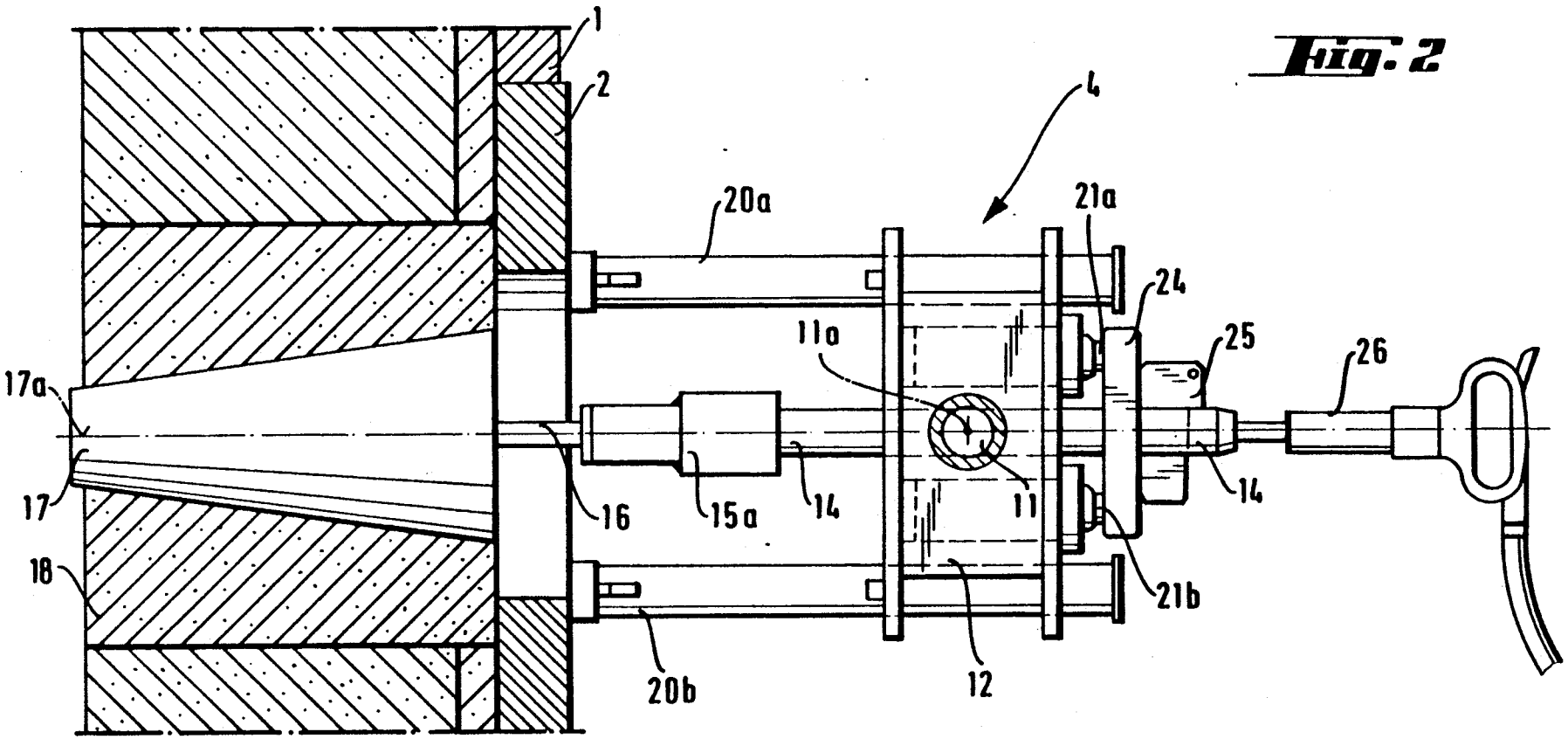

FIGS. 1 and 2 show the position of the device according to the present invention during the extraction of the gas purging plug 17 from the nozzle brick 18. Due to the vessel being pivoted, the ladle bottom 1 is brought into a vertical position, so that the axis 17*a* of the said gas purging plug 17 will be horizontal. A gas purging plug flange 2 is provided at the said ladle bottom 1 in the known manner. A holder 3 for the device 4 according to the present invention is welded to it [the said gas purging plug flange]. The coupling piece 5 of the said device 4 is detachably fastened to the said holder 3. A guide 7, which contains a bar arranged behind a cover 8, is hinged to the said coupling piece 5 pivotably around the axis 6*a* of the said first hinge 6. The said axis 6*a* is essentially vertical, so that the force of gravity does not have to be overcome during the pivoting of the said guide 7 around this said axis 6*a*. A slide 9 is slidably provided on the said bar. A head 12 is attached to the said slide 9 rotatably around the axis 11*a* of the second hinge 11. The said second hinge 11 is designed as a bolt, which is rigidly connected to the said slide 9, and engages a corresponding bore of the said head 12. The said axis 11*a* of the said second hinge 11 is at right angles to the said axis 6*a* of the said first hinge 6.

Furthermore, a disk 10*a*, which has a plurality of holes in the area of its circumference, which a locking means 10 is able to engage, is rotatably mounted on the said bolt of the said slide 9. The said disk 10*a* is connected to the said head 12 via a fine adjustment means 13 designed as a threaded spindle. Pivoting of the said head 12 around the said second axis 11*a* is brought about by releasing the said locking means 10 and rotating the said disk 10*a* and the said head 12 together. When the desired position, i.e., the horizontal position for introducing the said gas purging plug 17, is reached, further movement is prevented by the said locking means 10 snapping into a corresponding bore of the said disk 10*a*. Via the said fine adjustment means 13, the said head 12 can be slightly rotated in relation to the said disk 10*a*, so that accurately centric introduction of the said gas purging plug 17 is made possible.

A guide tube 14 is mounted axially slidably in the said head 12. The tongs 15*a* for extracting the said gas purging plug 17 is coupled to the front end of the said guide tube 14 via a bayonet catch. The said tongs 15*a* can easily be coupled with the said gas connection pipe 16 of the said gas purging plug 17 via a closing mechanism 19. Two hydraulic plungers 21*a* and 21*b*, which act on a pressure plate 24, which introduces the force into the said guide tube 14 via a wedge 25 inserted into the said guide tube 14 during the extraction process, are attached to the said head 12. The said head 12 is supported on the said gas purging plug flange 2 via support plungers 20*a* and 20*b*. The said support plunger 20*a* is omitted in FIG. 1 for clarity's sake. Via a hydraulic line 22, represented schematically, the said hydraulic plungers 21*a* and 21*b* are connected to a hydraulic pump 23, which is designed as a hand pump, attached to the said guide 7, in the exemplary embodiment.

Figure 3:
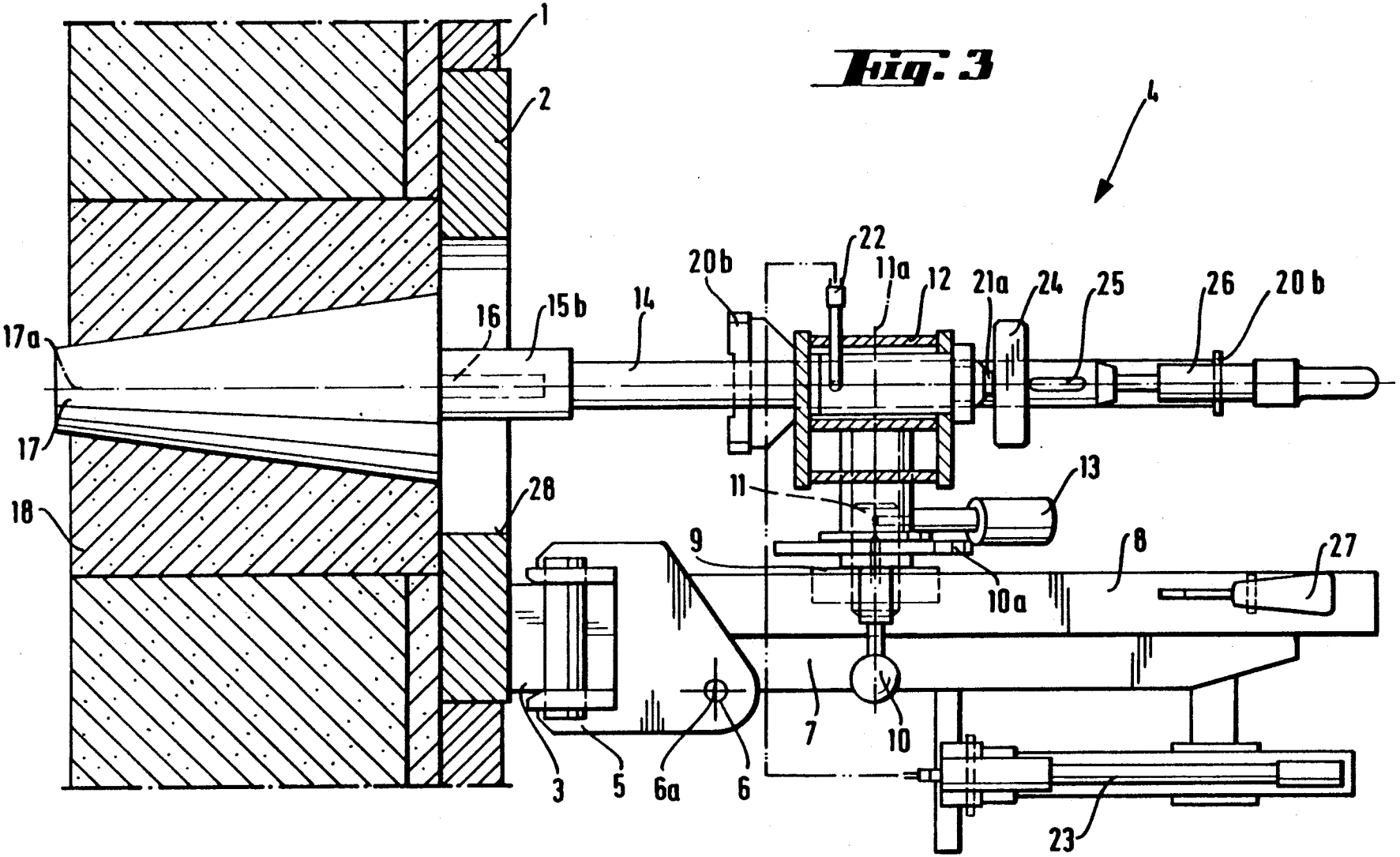
Figure 4:
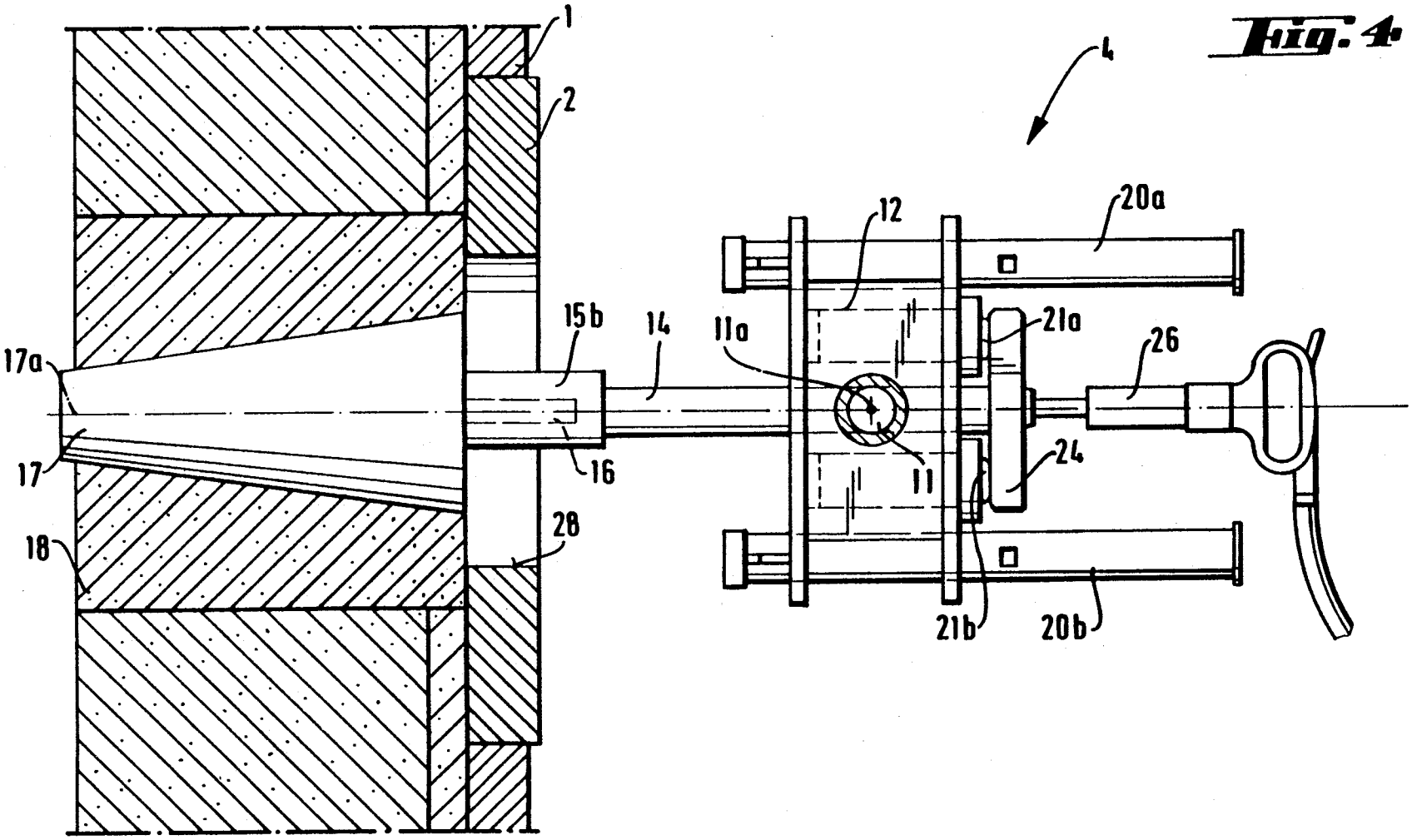

In FIGS. 3 and 4, a thrust piece 15*b* for inserting the said gas purging plug 17 is coupled to the said guide tube 14. The said gas connection pipe 16 is directly introduced into the thrust piece 15*b* and the said guide tube 14. A compressed-air hammer 26, with which the force needed for insertion can be applied, is attached to the end of the said guide tube 14. The force is applied to the bottom plate of the said gas purging plug 17 via the said thrust piece 15*b*.

It is clear that it is possible to combine the functions of the said tongs 15*a* and of the said thrust piece 15*b* in a single component. Such a component may then be made in one piece with the said guide tube 14.

Figure 5:
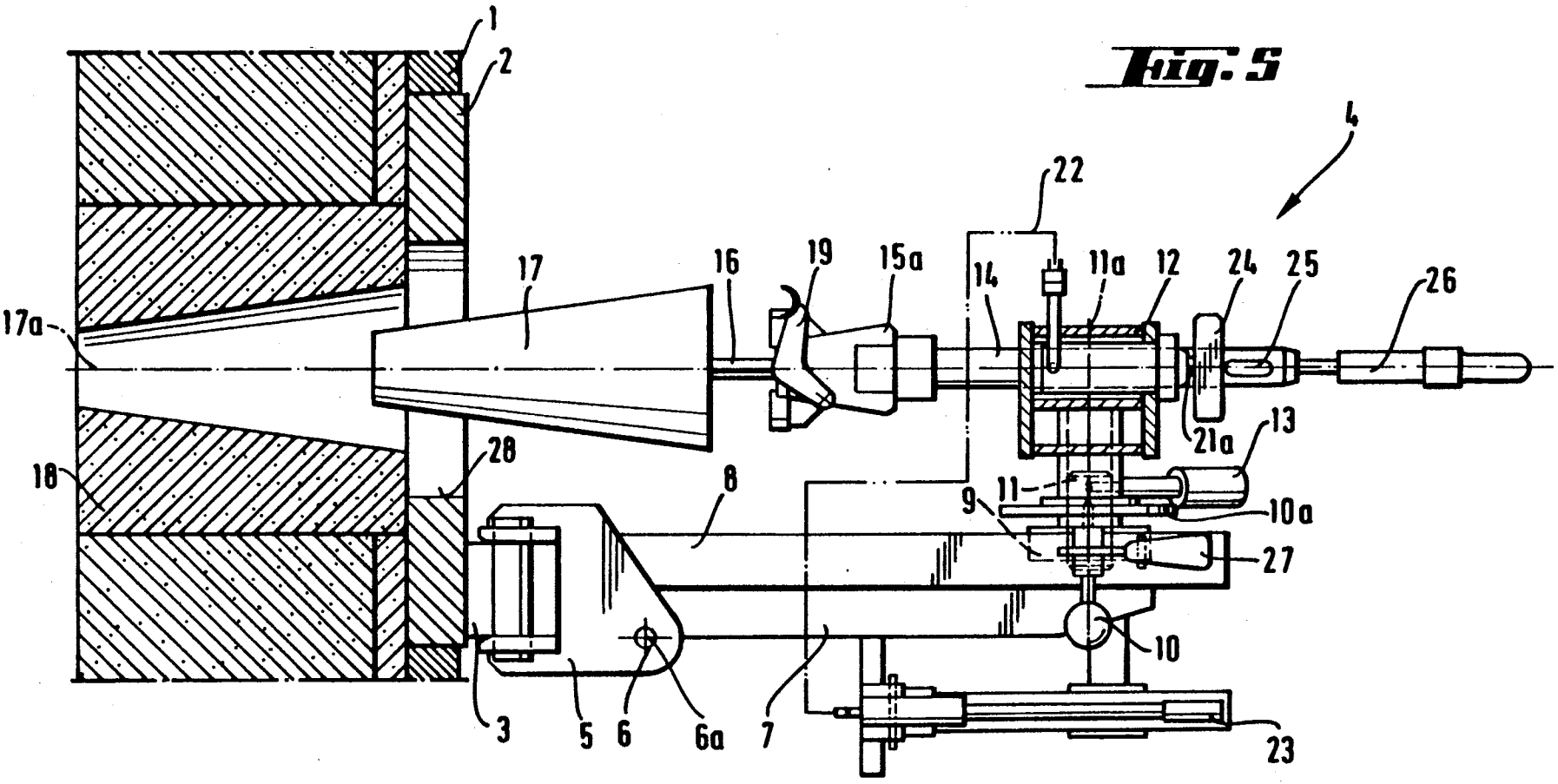

FIG. 5 shows the said device 4 in a position, in which the said slide 9 has been pushed into the outermost position on the said guide 7 after extraction. The said slide 9 is held in this position by the end position-securing means 27.

Figure 6:
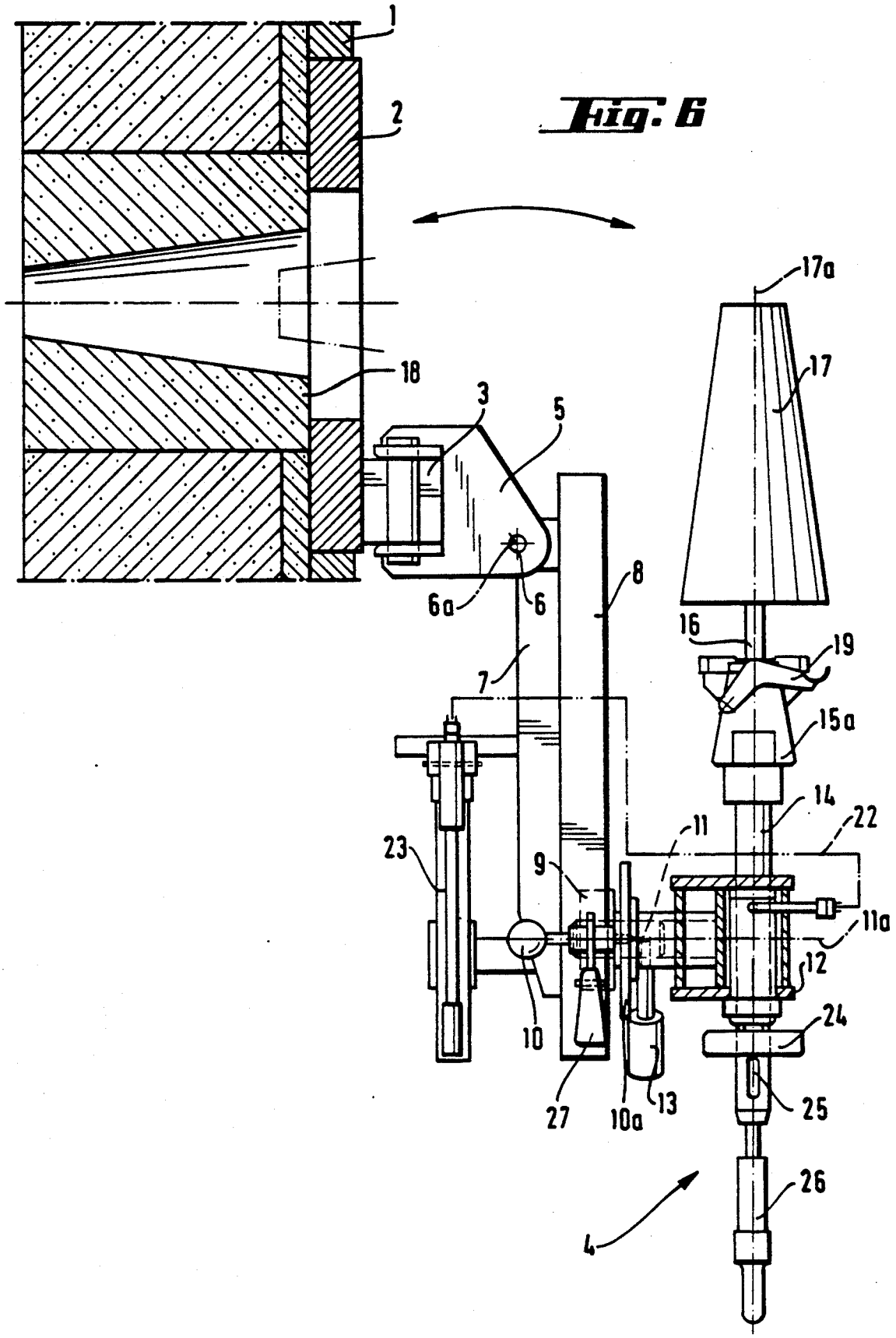

In FIG. 6, the said guide 7 and consequently also the said slide 9 and the said head 12 are pivoted, together with the said guide tube 14 and the said gas purging plug 17, around the axis 6*a* of the said first hinge 6 by about 90°.

Figure 7:
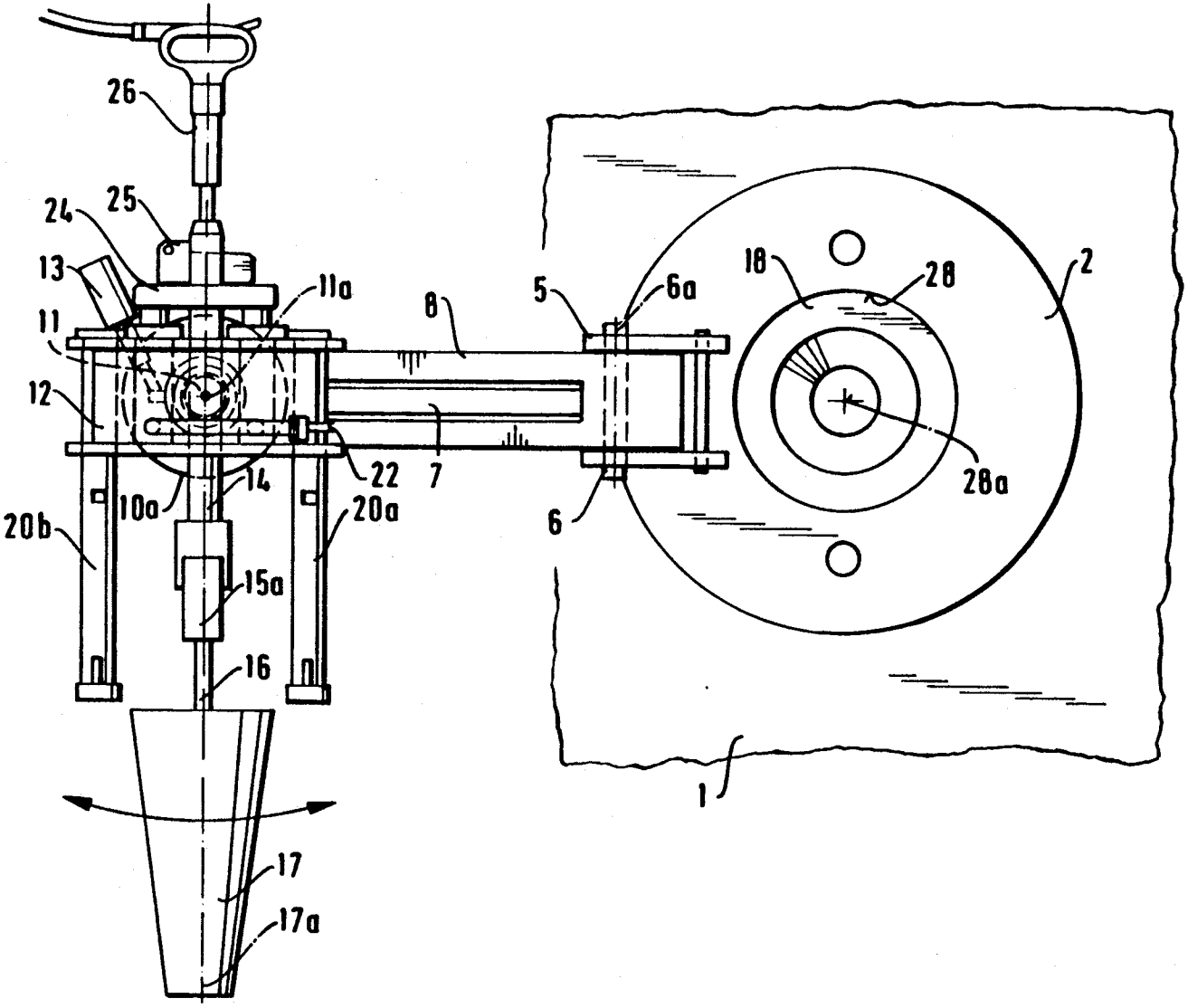

In FIG. 7, the said head 12 is rotated by 90° around the said axis 11*a* of the said second hinge 11 in relation to the said slide 9 such that the said axis 17*a* of the said gas purging plug 17 is essentially vertical, and the said gas purging plug 17 is directed downward. The said gas purging plug 17 can easily be discarded in this position.

Figure 8:
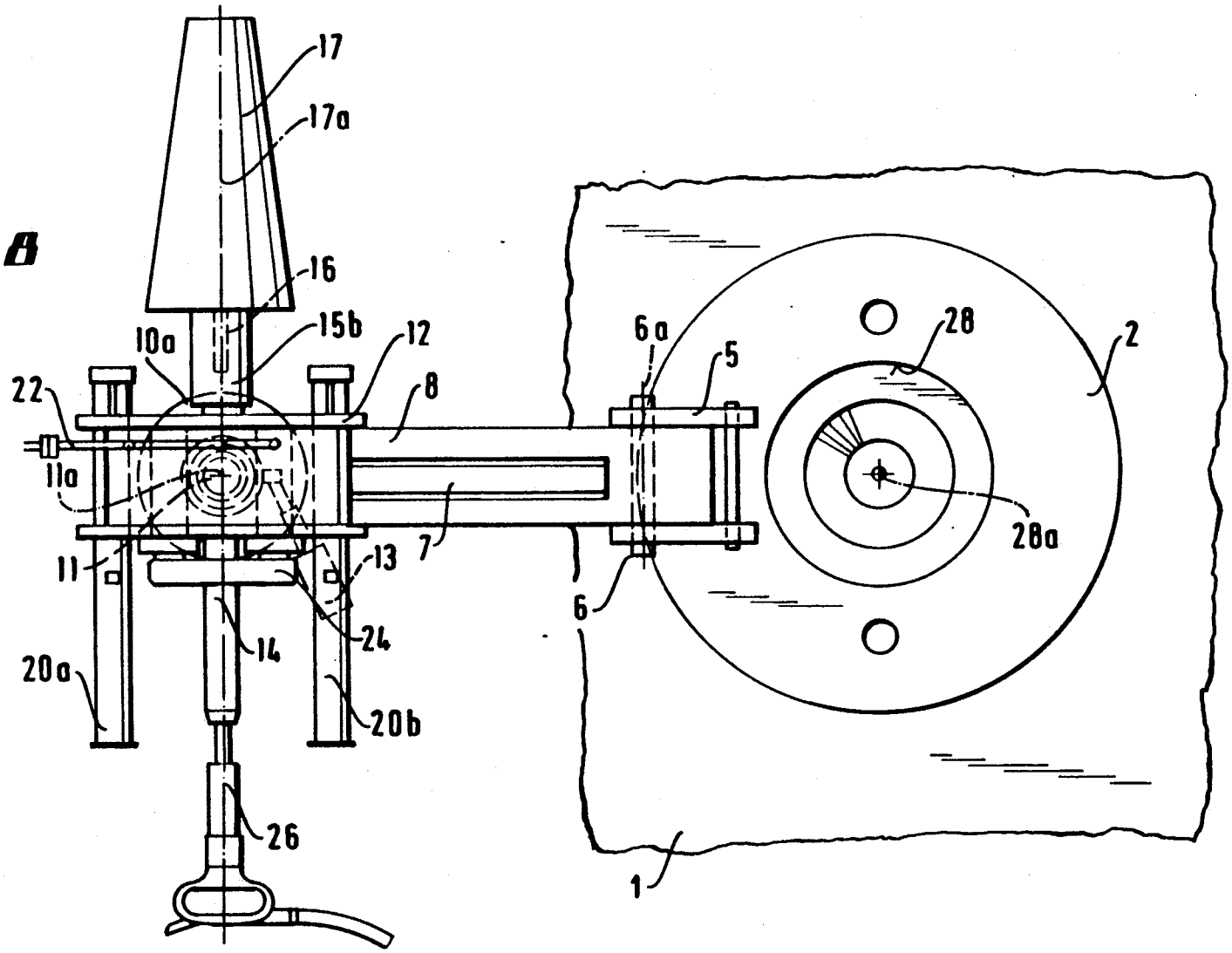

In FIG. 8, the said head 12 is rotated by 90° around the said axis 11*a* of the said second hinge 11 in relation to the said slide 9 such that the said axis 17*a* of the said gas purging plug 17 is essentially vertical, and the said gas purging plug 17 is directed upward. A new gas purging plug 17 is attached in this position, and the necessary layer of mortar is subsequently applied to this said gas purging plug 17. It is essential for the said gas purging plug 17 to be located at a relatively great distance from the opening 28 of the said gas purging plug flange 2 in this position, and especially to be pivoted out of the area of the said axis 28*a*, along which hot gases may be discharged. Unhindered working on the said gas purging plug 17 is thus possible, and it is guaranteed that the mortar layer is prevented from setting prematurely.

Figure 9:
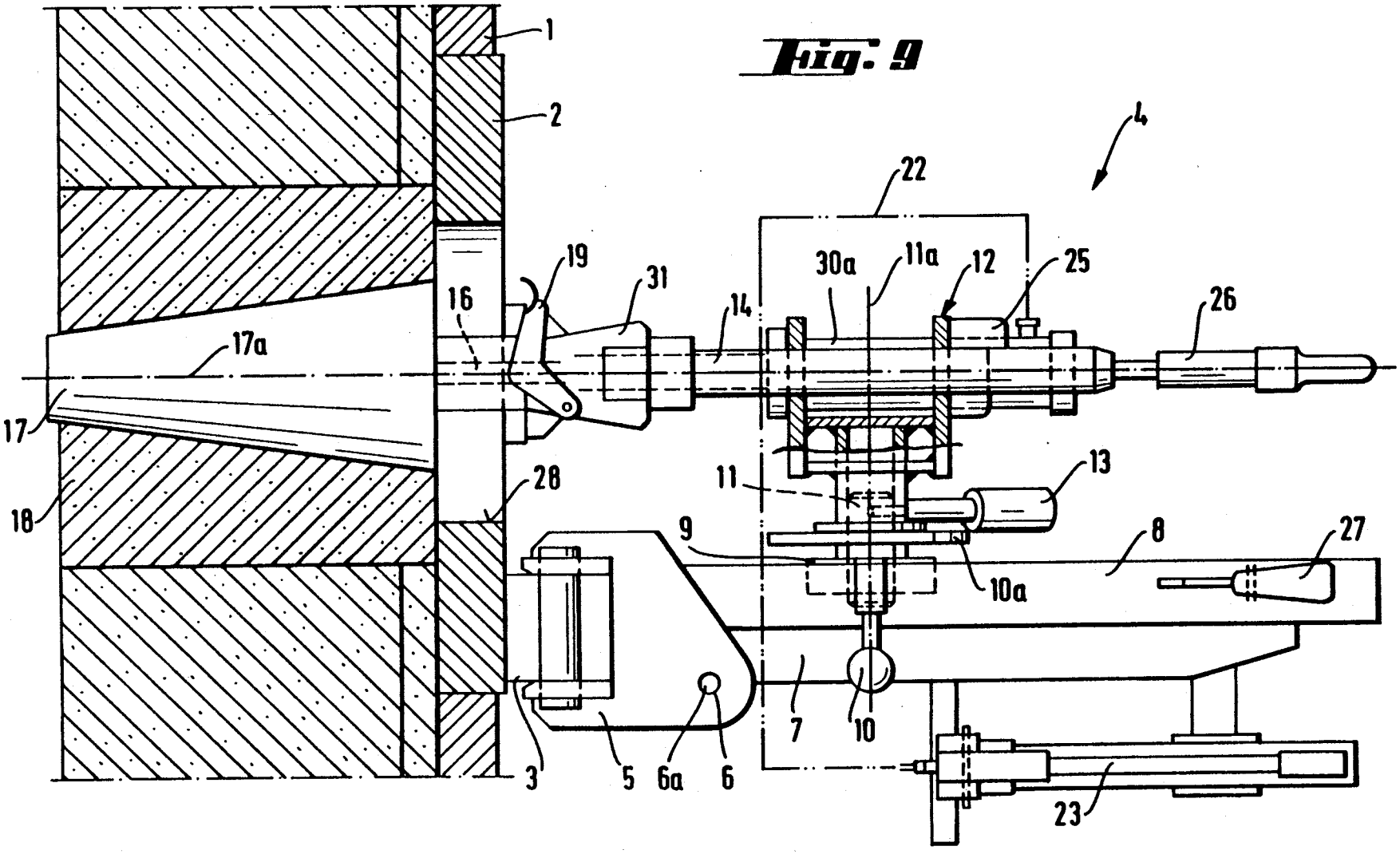
FIGS. 9 and 10 show a further design variant of the device according to the present invention; namely.
Figure 10:
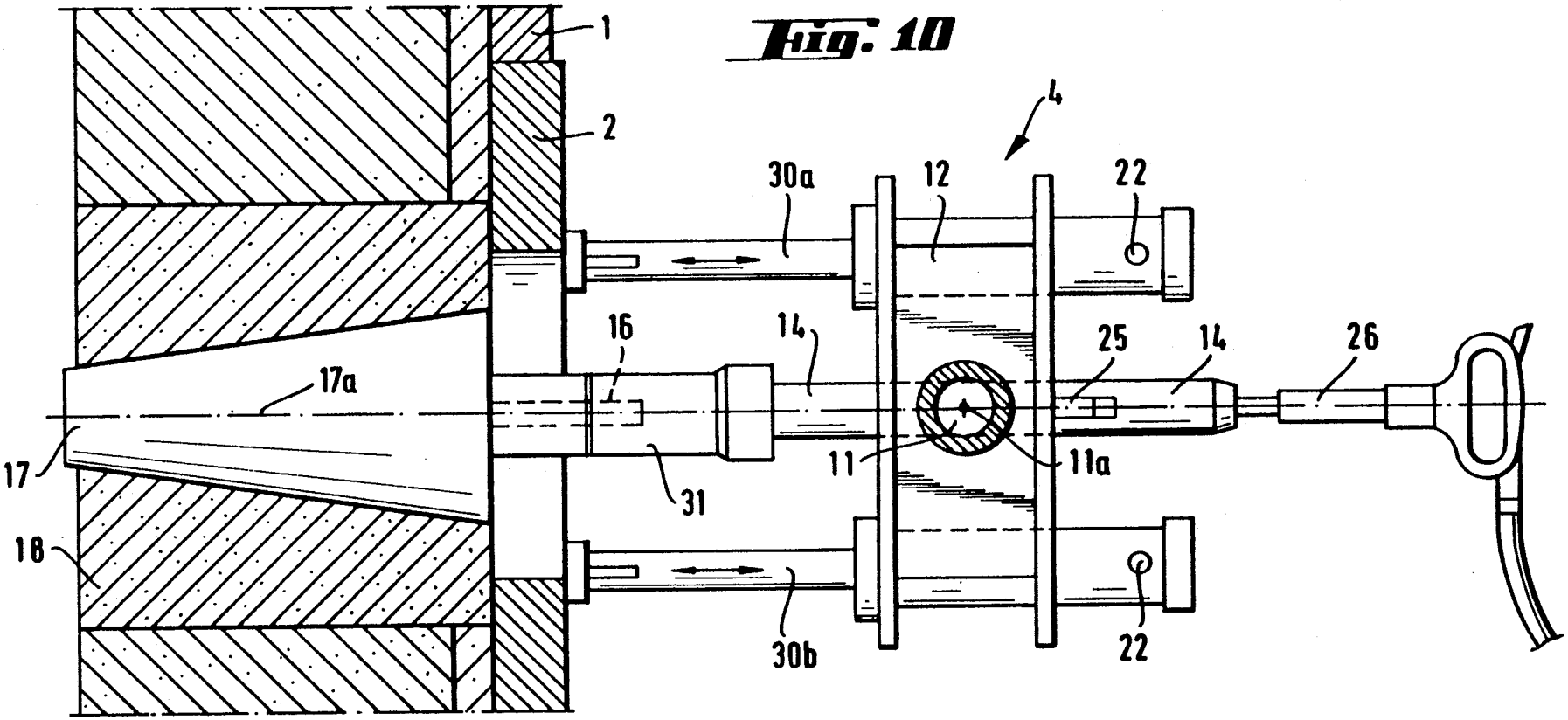

According to a second design variant of the device according to the present invention, which is shown in FIGS. 9 and 10, the support plungers used for the extraction process are designed as hydraulic plungers 30*a* and 30*b*, which act against the direction of extraction. The said hydraulic plungers 21*a* and 21*b*, as well as the said pressure plate 24 are omitted in this embodiment. All the grips for operating the supports are eliminated, because the said hydraulic plungers 30*a* and 30*b* are extended via the said hydraulic pump 23. The said plungers are withdrawn via a restoring spring provided in each said hydraulic plunger.

In this embodiment, the said gas purging plug 17 is installed and removed with the same tool 31, which is a combination of the said thrust piece 15*b* and the said tongs 15*a*. The said tool 31 is screwed onto the said guide tube 14. The frictional connection for the extraction process is established between the said guide tube 14, the said inserted wedge 25, and the said slide 9.

However, this design variant requires synchronous movement of the said two hydraulic plungers 30*a* and 30*b*, because warping of the device could otherwise occur.

We claim:

1. Device for installing and removing gas purging plugs (17) for metallurgical vessels, comprising a guide (7) for axially displacing the gas purging plug (17), a first hinge (6) having an axis (6*a*) for pivoting the gas purging plug into a maintenance position, and a second hinge (11), whose axis (11*a*) extends essentially at right angles to the axis (6*a*) of the first hinge (6).

2. Device in accordance with claim 1, wherein the guide (7) contains a bar, on which a slide (9) is slidably arranged.

3. Device in accordance with claim 2, wherein the first hinge (6) permits the guide (7) to be pivoted in relation to the vessel, and that the second hinge (11) permits the gas purging plug (17) to be pivoted in relation to the slide (9).

4. Device in accordance with claim 3, wherein the second hinge (11) rotatably holds on the slide (9) a head (12), which can be fixed by means of a locking means (10).

5. Device in accordance with claim 4, wherein a guide tube (14) for manipulating the gas purging plug (17) is guided axially displaceably in the head (12), and a tool (15*a*, 15*b*; 31) can be attached to the guide tube (14) for connection to the gas purging plug (17).

6. Device in accordance with claim 1 wherein support plungers (20*a* and 20*b*) for extracting the gas purging plug (17), which are arranged in a regular pattern around the axis (17*a*) of the gas purging plug (17), are provided.

7. Device in accordance with claim 4, wherein two support plungers (20*a* and 20*b*), whose axes are located in one plane, which contains the axis (17*a*) of the gas purging plug (17), are provided at the head (12).

8. Device in accordance with claim 1, wherein hydraulic plungers (21*a* and 21*b*) are provided for extracting the gas purging plug (17).

9. Device in accordance with claim 6, wherein the support plungers used for the extraction process are designed as hydraulic plungers (30*a* and 30*b*), which act against the direction of extraction.

10. Device in accordance with claim 1, further including mounting means mounting for a compressed-air hammer (26) for pressing the gas purging plug (17) into the vessel.

11. Device in accordance with claim 1, further including a coupling piece (5) for detachably fastening the device to the vessel.

12. Device in accordance with claim 1, wherein a fine adjustment means (13) is arranged in the area of the slide (9) for accurately aligning the gas purging plug (17).

13. Device for installing and removing gas purging plugs (17) for metallurgical vessels, comprising a guide (7) for axially displacing the gas purging plug (17), a first hinge (6) having an axis (6*a*) extending vertically for pivoting the gas purging plug into a maintenance position, and a second hinge (11), whose axis (11*a*) extends horizontally essentially at right angles to the axis (6*a*) of the first hinge (6), the first hinge (6) being detachably coupled to the metallurgical vessel, the guide (7) being pivotally connected to the first hinge (6), wherein the guide (7) contains a bar, on which a slide (9) is slidably arranged, wherein the first hinge (6) permits the guide (7) to be pivoted in relation to the vessel, and the second hinge (11) permits the gas purging plug (17) to be pivoted in relation to the slide (9), wherein the second hinge (11) is rigidly connected to the slide (9) and rotatably holds on the slide (9) a head (12), which can be fixed by means of a locking means (10), wherein a guide tube (14) for manipulating the gas purging plug (17) is guided axially displaceably in the head (12), and a tool (15*a*, 15*b*; 31) can be attached to the guide tube (14) for connection to the gas purging plug (17), wherein support plungers (20*a* and 20*b*) for extracting the gas purging plug (17), which are arranged in a regular pattern around the axis (17*a*) of the gas purging plug (17), are provided, wherein two support plungers (20*a* and 20*b*), whose axes are located in one plane, which contains the axis (17*a*) of the gas purging plug (17), are provided at the head (12), wherein hydraulic plungers (21*a* and 21*b*) are provided for extracting the gas purging plug (17), further including mounting means for mounting a compressed-air hammer (26) for pressing the gas purging plug (17) into the vessel, further including a coupling piece (5) for detachably fastening the device to the vessel, wherein a fine adjustment means (13) are arranged in the area of the slide (9) for accurately aligning the gas purging plug (17).

14. Device in accordance with claim 13, wherein the support plungers used for the extraction process are designed as hydraulic plungers (30*a* and 30*b*), which act against the direction of extraction.

* * * * *